United States Patent [19]

Jacques et al.

[11] 4,452,015

[45] Jun. 5, 1984

[54] BALANCING DEVICE FOR AUTOMOBILE DECK LID

[75] Inventors: Bascou Jacques, Maule; Roue Yves, Puteaux, both of France

[73] Assignee: Regie Nationale des Usines Renault, Boulogne-Billancourt, France

[21] Appl. No.: 413,713

[22] Filed: Sep. 1, 1982

[30] Foreign Application Priority Data

Sep. 4, 1981 [FR] France ..... 81 16818

[51] Int. Cl.[3] ..... E05F 1/10

[52] U.S. Cl. ..... 49/386; 49/379; 49/344

[58] Field of Search ..... 49/379, 386, 344, 346

[56] References Cited

U.S. PATENT DOCUMENTS

| | | | |
|---|---|---|---|
| 381,112 | 4/1888 | Colby | 49/379 X |
| 736,714 | 8/1903 | Gendron | 49/386 X |
| 2,544,500 | 6/1951 | Jacobi . | |
| 3,747,271 | 7/1973 | Adamski | 49/344 X |
| 3,818,637 | 6/1974 | Vivier | 49/386 X |
| 4,185,415 | 1/1980 | LaConte | 49/379 X |
| 4,365,442 | 12/1982 | Speer | 49/344 X |

FOREIGN PATENT DOCUMENTS 643216 5/1964 Belgium .

*Primary Examiner*—Kenneth Downey
*Attorney, Agent, or Firm*—Oblon, Fisher, Spivak, McClelland & Maier

[57] ABSTRACT

A balancing device consists of at least one balancer, for example a pneumatic jack, one end of which is connected to the deck lid by a swivel joint and whose other end is hinged to the vehicle body. The balancer is hinged to the vehicle body through a bent return lever consisting of two unequal arms and is attached at its bend to the vehicle body about an axis parallel to the hinge axis of the hatchback. The end of the arm oriented toward the axis forms a hinge for the said other end of the balancer while the end of the other arm of the bent lever is in contact with the concave cam surface of a cam attached to the deck lid.

4 Claims, 5 Drawing Figures

FIG. 2
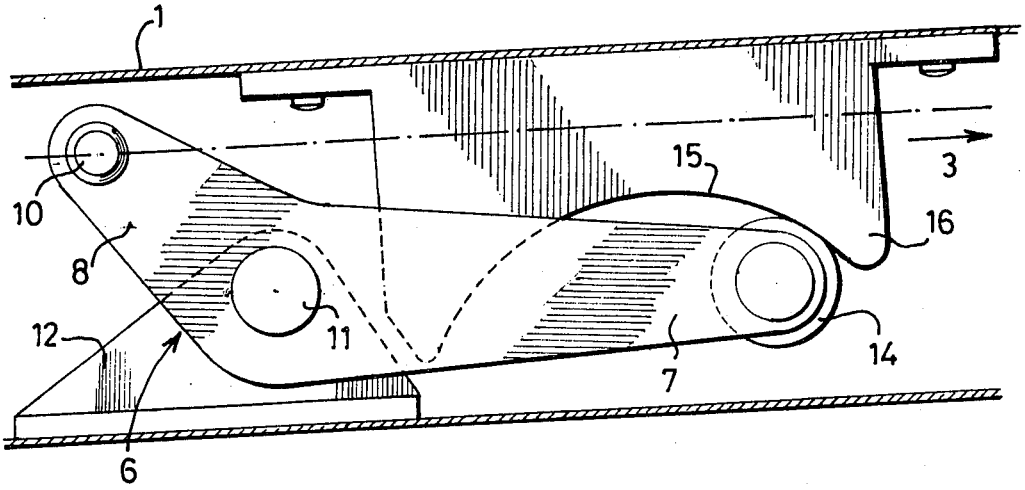
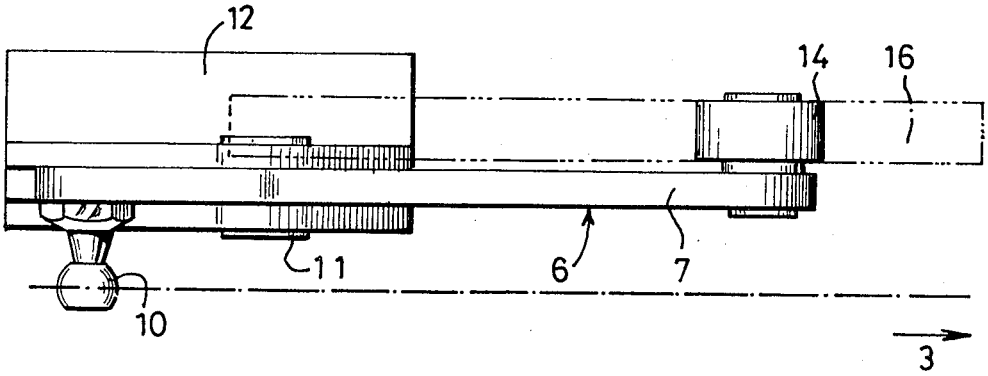
FIG. 3

BALANCING DEVICE FOR AUTOMOBILE DECK LID

BACKGROUND OF THE INVENTION

1. Field of the Invention

This invention concerns a device for balancing a deck lid intended for use on an automobile.

2. Description of the Prior Art

In vehicles with deck lids, their balancing is customarily provided with the help of pneumatic jacks or balancers generally placed in the vehicle's side gutters, said balancers being designed to offset the weight of the lid and facilitate its opening and closing.

Unfortunately, these known balancers do not always provide balance characteristics which correspond to technical demands or to the desired kinematic functioning, with the result that the balancing of the lid and, as a consequence, its handling are not always satisfactory.

Belgian Pat. No. 643,216 describes a manual device for the opening of a sunroof. The device includes an equalizer mechanism, one end of which is connected to the sunroof and the other is hinged to the body by means of a bent counterlever consisting of two unequal arms, said counterlever being attached at its bend to the body about an axis which parallels the hinge axis of the sunroof. The end of one of the arms is in contact with a plane rolling track attached to the sunroof. This device, thanks to the presence of the bent lever, makes it possible to obtain automatic opening of the sunroof as soon as the lock holding it closed has been released.

SUMMARY OF THE INVENTION

The object of the present invention is to improve the device described in Belgian Pat. No. 643,216 and is aimed in particular, as regards its application to an automobile deck lid, at obtaining a specific curve for the balancing force as a function of the angle of opening and independent of the characteristics of the balancer alone.

To this end, the invention proposes a device for the balancing of an automobile deck lid, said lid being hinged to the vehicle body about a horizontal axis. The device consists of at least one balancer, one end of which is connected to the deck lid by a swivel joint separated from said horizontal axis, and whose other end is connected to the vehicle body through a bent counterlever consisting of two unequal arms and attached at its bend to the vehicle body about an axis parallel to the hinge axis of the lid itself. The end of the arm oriented toward the axis forms a hinge for the said other end of the balancer. The end of the other arm of said lever is in contact with the concave cam surface of a cam attached to the lid.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein:

FIGS. 2 and 3 are detailed views of a portion of the device shown in FIG. 1;

DETAILED DESCRIPTION OF THE PREFERRED EMBODIMENTS

Figure 1:
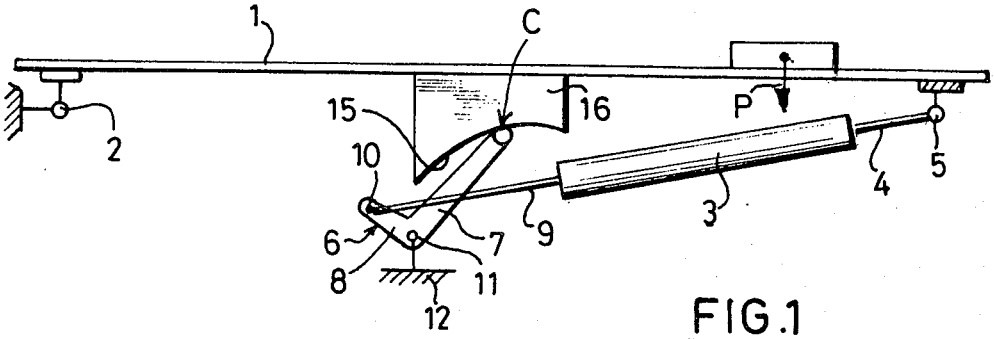
FIG. 1 is a schematic view of one embodiment of the balancing device according to the invention.

In the embodiment shown in FIGS. 1 to 4, the balancing device according to the invention, is attached to the deck lid of a vehicle, the lid 1 being hinged to the vehicle body about a horizontal axis 2. The device includes, in a known manner, a balancer 3, which may be a pneumatic jack, attached at one of its ends 4, opposite the axis 2, to the deck lid 1 by means of a swivel joint or analogous joint 5 and a bent return lever 6 consisting of two arms 7 and 8 which are unequal in length and substantially perpendicular to each other. The other end 9 of the balancer 3 is connected by a swivel joint 10 to the end of the arm 8 of the said lever 6, which is hinged at its bend about an axis 11, substantially parallel to the axis 2, connected to the body of the vehicle at 12.

The end of the arm 7 of the lever 6 features a roller guide 14 which is in contact with the concave surface 15 of a cam 16 attached to the deck lid 1, with the concavity of the said cam being oriented toward the inside of the lid and the arm 8 of the lever 6 being largely oriented toward the axis 2. Arrow P schematically represents the weight of the lid.

The balancer 3, connected to the deck lid 1 at hinge point 5, exerts a force $F_1$ on the end 10 of the bent return lever 5, said force $F_1$ being oriented along the straight line joining the axes 5 and 10 of the hinges supporting the balancer 3.

The force $F_1$ multiplied by the lever arm $d_1$ of the arm 8 of lever 6 (where $d_1$ is the distance between the axis 11 and the straight line passing through axes 5 and 10, in a direction normal to said straight line) applies a couple $C_1=F_1\times d_1$ to the bent lever 6.

The couple $C_1$ divided by the lever arm $d'_1$ of the arm 7 of lever 6 (where $d'_1$ is the distance separating the axis 11 from the normal N to the surface of the cam 15 passing through the point of contact C of the roller 14 with the latter) exerts a force $F_2=C_1/d'_1$ on the cam 16 and hence the deck lid 1.

The force $F_2$ multiplied by the lever arm $d_2$ (where $d_2$ is the distance separating the axis 2 from the normal N to the surface of the cam 15, that is, from the support for force $F_2$) exerts an opening couple of $C_2=F_2\times d_2$ on the deck lid 1.

We thus have $$C_2 + F_1 \times \frac{d_1}{d_1'} \times d_2.$$

Figure 4:
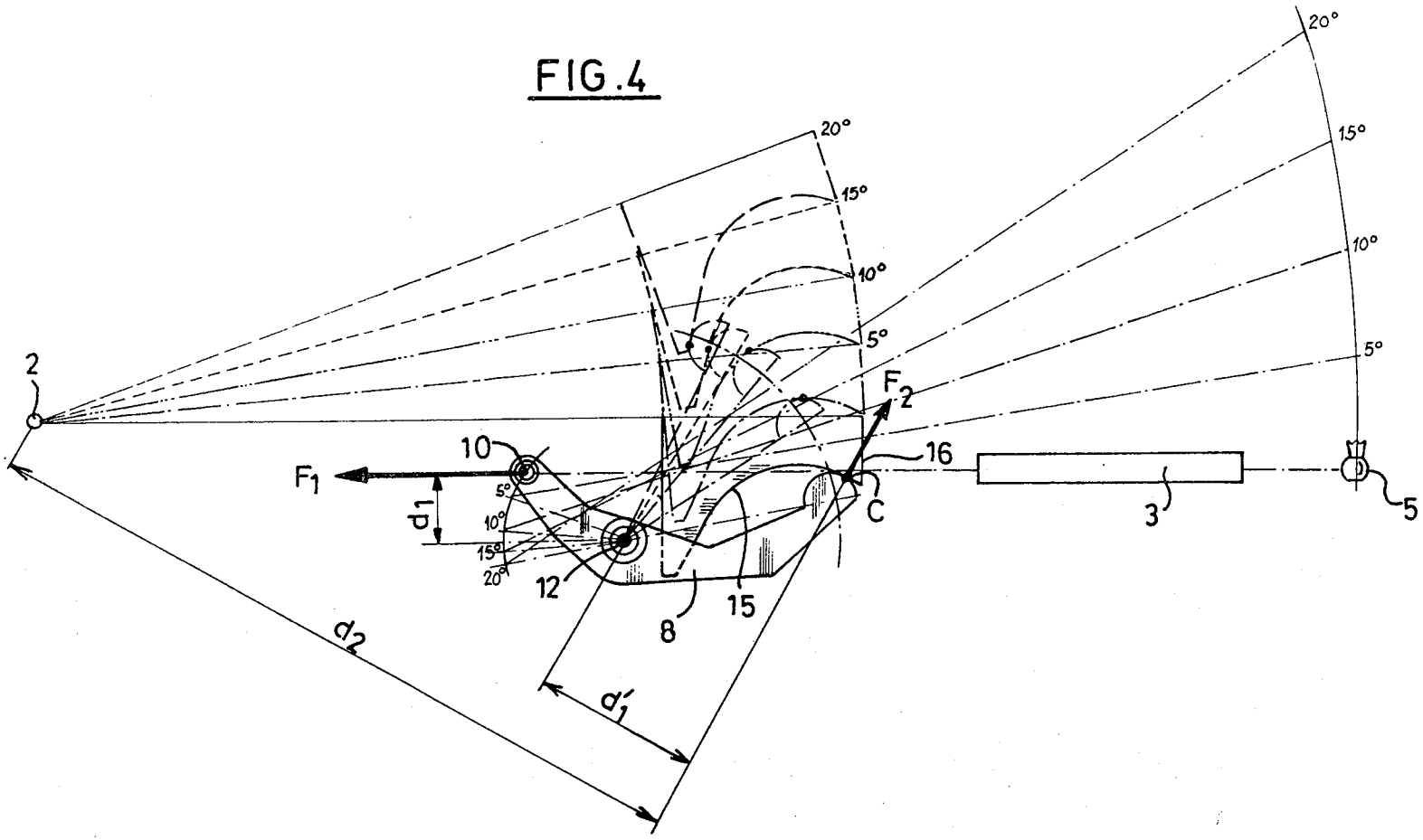
FIG. 4 a view similar to that in FIG. 1, showing the geometry of the device in several opening positions.

Also shown in FIG. 4 are four opening positions of the lid 1 (as well as the corresponding positions of the lever 6 and the cam 16) in 5° increments, corresponding to lid opening angles of 5°, 10°, 15° and 20°. This illustration facilitates understanding of the principle of designing the shape of cam surface 15 as a function of the final real balancing curve one desires to obtain. Indeed, for each angle of opening of the hatchback it suffices to determine geometrically the shape of the cam surface 15 in order to arrive at a desired corresponding value of $C_2$. This precise determination has the effect of obtaining a profile for the surface of cam 15 which is irregular and would scarcely be compatible with a smooth and shock-free handling of the lid, so it is necessary to connect the theoretically determined points C by a continuous concave curve, this having the consequence of slightly modifying the theoretical balancing curve and yielding the final real balancing curve.

Figure 5:
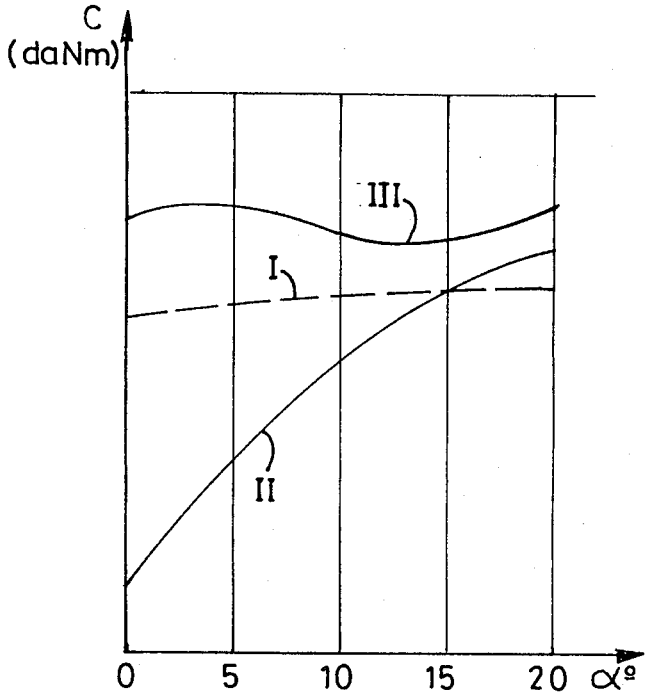
FIG. 5 is a graph illustrating the improved balancing obtained with the device according to the invention as compared to a customary device with balancers.

FIG. 5 presents a diagram showing the opening angle $\alpha_0$ of the deck lid on the abscissa and, on the ordinates, the resisting couple provided by the deck lid by virtue of its mass P (curve I); the couple attributable to the balancer 3, without the bent return lever (curve II); and the real balancing couple $C_2$ obtained by the device of the invention (curve III).

Assistance in opening occurs during the trajectory of the deck lid between $\alpha_1=0$ (opening of the hatchback) and $\alpha_2$, an arc on the order of 20°.

The device according to the invention is simple and reliable and provides a better distribution of the energy contained in the balancer, guaranteeing the automatic opening of the deck lid as soon as its lock is released.

Although the description has been limited to that of a device consisting of one balancer associated with one return lever and one cam, it goes without saying that such a unit may to good advantage be deployed on each side of the deck lid to be balanced.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for the balancing of an automobile deck lid, said lid being pivoted to a vehicle body about a first horizontal axis at one end of said lid, said device comprising:

at least one balancer, one end of each said balancer being pivotally connected to said lid at a point spaced from said one end of said lid;

a bent counterlever for each said balancer, each said counterlever comprising a first arm, a second arm having a length unequal to said first arm and a bend between said first and second arms, said counterlever being pivoted to said vehicle body about a second axis parallel to said first axis, said first arm extending towards said first axis at a distal end, wherein a second end of each said balancer is pivotally connected to said distal end of a corresponding said first arm; and a cam fixed to said lid, said cam including a curved cam surface, wherein a distal end of said second arm is in contact with said cam surface.

2. The device of claim 1 wherein said cam surface is a concave surface.

3. The device of claims 1 or 2 wherein said first and second arms extend substantially perpendicular to one another.

4. The device of claims 1 or 2 wherein said distal end of said second arm includes a roller providing said contact with said cam surface.

* * * * *